United States Patent [19]

Hawk et al.

[11] Patent Number: 4,761,141

[45] Date of Patent: Aug. 2, 1988

[54] LOCKING LATCHING SHROUD

[75] Inventors: Gary W. Hawk, Halifax; Joseph C. Marzili, Palmyra, both of Pa.

[73] Assignee: AMP Incorporated, Harrisburg, Pa.

[21] Appl. No.: 21,379

[22] Filed: Mar. 3, 1987

[51] Int. Cl.[4] ..... H01R 13/629

[52] U.S. Cl. ..... 439/153; 439/346

[58] Field of Search ..... 439/152–160, 439/310, 330, 345, 346, 368, 370, 372, 374, 377, 692, 695, 733, 296, 660, 869

[56] References Cited

U.S. PATENT DOCUMENTS

| | | | |
|---|---|---|---|
| 3,157,452 | 11/1964 | Dorjee et al. | 439/733 |
| 3,942,858 | 3/1976 | Ouchi | 439/346 |
| 4,173,387 | 11/1979 | Zell | 439/557 |
| 4,178,051 | 12/1979 | Kocher et al. | 439/157 |
| 4,241,966 | 12/1980 | Gomez | 339/45 M |
| 4,469,388 | 9/1984 | Narozny | 439/153 |
| 4,509,812 | 4/1985 | Lotter | 439/296 |
| 4,589,718 | 5/1986 | Szczesny | 439/395 |
| 4,597,618 | 7/1986 | Reimer | 439/374 |

FOREIGN PATENT DOCUMENTS

| | | |
|---|---|---|
| 0004422 | 3/1979 | European Pat. Off. . |
| 0054092 | 12/1980 | European Pat. Off. . |

*Primary Examiner*—Gil Weidenfeld
*Assistant Examiner*—Gary F. Paumen
*Attorney, Agent, or Firm*—David L. Smith

[57] ABSTRACT

A shroud (10) for reception on a pin array (12) in a printed circuit board (14) has walls (28, 30) defining a cavity (24) for receiving a complementary mating connector (26). A latch lever (36) in the wall (32) pivots on a shaft (42) a portion of which is a cam (52). Cam (52) biases a pin (12*a*) of the array of pins (12) against a surface (58) of the shroud (10) thereby securing the shroud (10) to the pin array (12). A locking portion (38) of the latch lever (36) latchingly engages a V-slot lock (54) in mating connector (26). An eject portion (40) of the latch lever (36) passes between adjacent rows of pins (12) to engage the mating face of connector (26) received in cavity (24). Shroud (10) is adapted to be plugged into the pin array (12) without removing any pins (12) thereby preserving all pins for repositioning of shroud (10) or for other termination techniques. The shroud (10) housing may be profiled (27) for polarization or keying.

22 Claims, 5 Drawing Sheets

LOCKING LATCHING SHROUD

BACKGROUND OF THE INVENTION

This invention relates to a shroud for a pin array in a printed circuit board having a latch to effect latching of a connector into engagement with the pins of the array within the shroud and in particular to a latching shroud that simultaneous to latching a connector into the shroud locks the shroud to the pin field on the printed circuit board.

Techniques exist for securing a shroud for a pin array to the circuit board in which the pins are mounted. U.S. Pat. No. 4,589,718 discloses a shroud having cavities in the base thereof to receive formed locking clips. Each locking clip is a planar spring having an aperture therein for biased engagement with a pin, thereby retaining the shroud to the pin array.

U.S. Pat. No. 4,173,387 discloses a snap-on shroud assembly for one or both sides of a printed circuit board. The shroud is retained by mounting legs having outwardly directed arcuate patent shoulders that snap into an aperture in the printed circuit board.

Other prior art techniques include using bolts and nuts or rivets to secure a pin shroud to a circuit board. The bolts and rivets require apertures through the circuit board as well as the shroud housing typically necessitates removing one or more pins. Furthermore, bolts sometimes caused a shorting problem between pins adjacent thereto.

Removing pins from the pin field eliminates future use of the pin. It would be desirable to have a shroud that could be plugged into a pin field as well as be secured therein without removing any pins such that upon removal of the shroud, all pins would be available for future use such as repositioning the shroud.

SUMMARY OF THE INVENTION

A shroud for reception on a pin array in a printed circuit board has a latch lever in the wall thereof. The latch lever pivots on a shaft, a portion of which is a cam. The cam biases a pin against the shroud housing thereby securing the shroud to the pin field. An eject portion of the latch lever passes between adjacent rows of pins to engage the mating face of a complementary mating connector received in the shroud cavity. The shroud housing is adapted to be plugged into the pin field without removal of any pins thereby preserving all pins for repositioning of the shroud or for other termination techniques. Some of the pins that pass through pin receiving apertures in the shroud are not useable but the unuseable pins need not be removed from the board. The shroud housing may be profiled for polarization or keying.

DESCRIPTION OF THE PREFERRED EMBODIMENT

Figure 1:
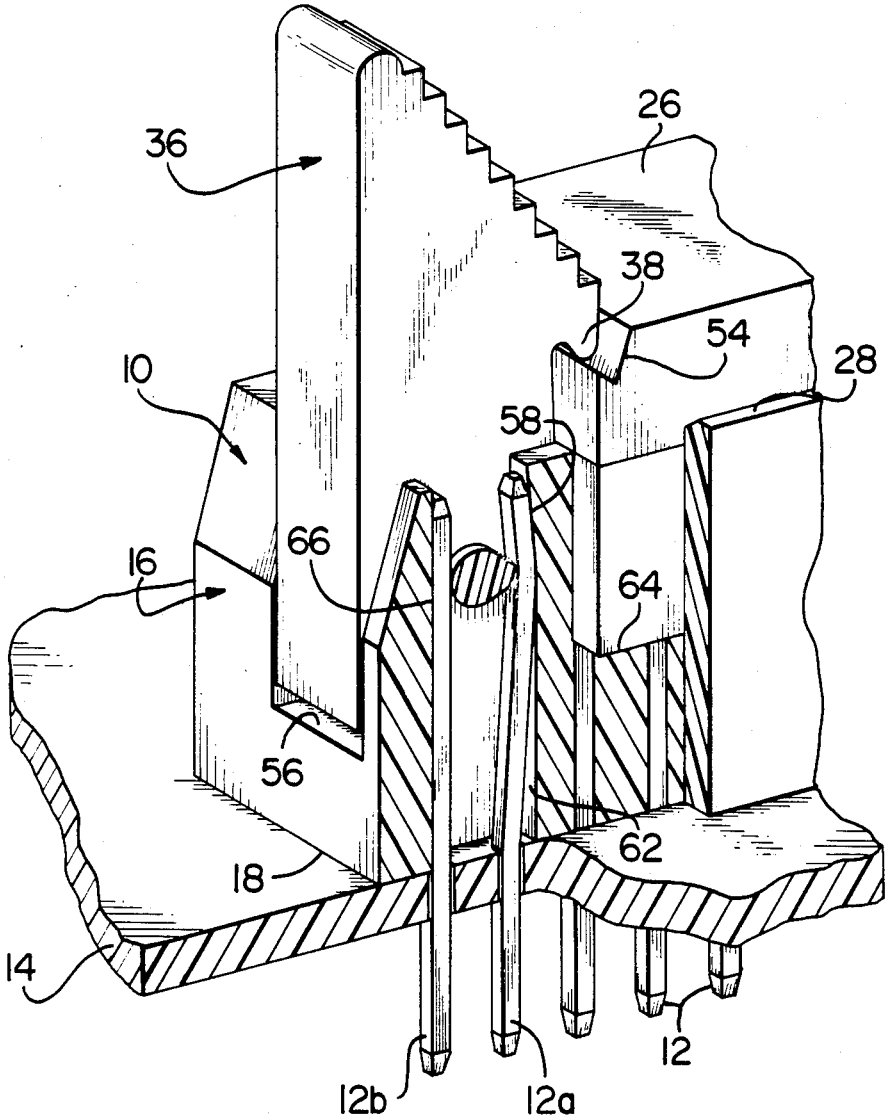
FIG. 1 is a cutaway partial perspective of a shroud in accordance with the present invention received on a pin array extending from a printed circuit board with the shroud latched to a complementary connector.
Figure 2:
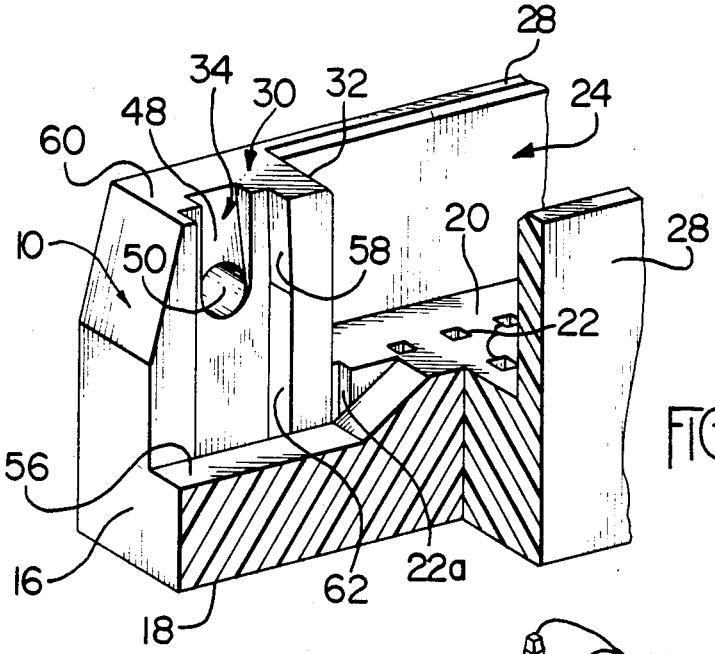
FIG. 2 is a cutaway partial perspective of a shroud.

Referring to FIG. 1, there is depicted therein a shroud 10 in accordance with the present invention on an array of pins 12 protruding from a printed circuit board 14. As seen in FIG. 2, shroud 10 comprises an elongate dielectric housing having a base 16 having a bottom surface 18, an opposed top or inside surface 20 and a plurality of pin receiving passages 22 extending therebetween with the spacing of passages 22 corresponding to the spacing of pins 12. Typical posts are 0.025 inch square spaced on a 0.100 inch grid. Pins 12 extend beyond surface 18 into elongate cavity 24 which receives a complementary mating connector 26 typically connected to a cable (not shown). Base 16 is bounded by opposed external sidewalls 28 and opposed external endwalls 30 which define cavity 24. Cavity 24 may be profiled with polarizing or keying projections 27. Pin receiving passages **22*a* adjacent the inner surface 32 of endwall 30 provide an interference fit retention force between shroud 10 and pins 12 passing therethrough to hold shroud 10 on pin array 12 when there is no complementary connector 26** secured therein.

Figure 3:
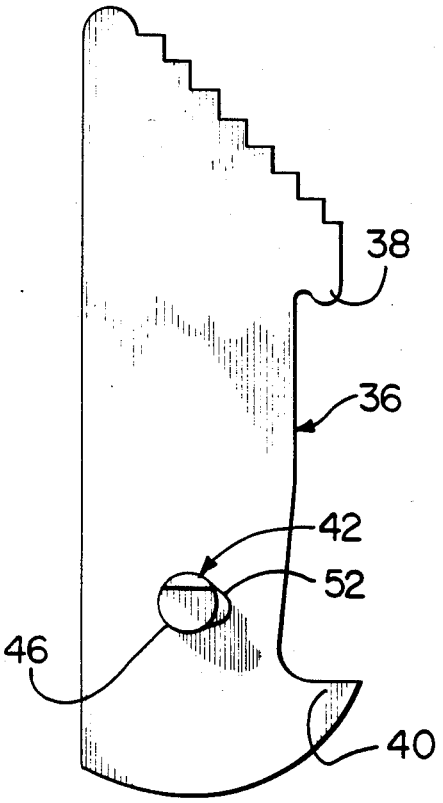
FIG. 3 is a side view of a latch lever.
Figure 4:
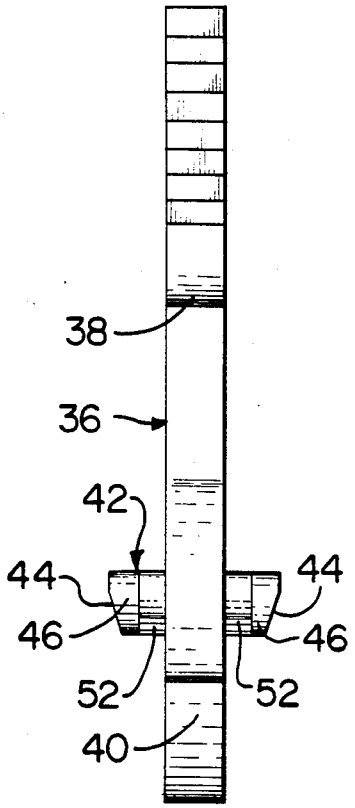
FIG. 4 is an end view of a latch lever.

The housing of shroud 10 has a latch lever recess 34 therein, preferably in each endwall 30, as best seen in FIG. 2. A latch lever 36 shown in FIGS. 3 and 4 is pivotally mounted in each recess 34. Latch lever 36 has a width that is less than the spacing between adjacent rows of pins 12, a latching shoulder 38, a foot 40 and an integral pivot shaft 42. Pivot shaft 42 has a tapered end 44 on a cylindrical portion 46 thereof. The tapered end of shaft 42 facilitates insertion into tapered channel 48 of recess 34 during assembly of shroud 10. Shaft 42 seats in cylindrical aperture or cavity 50 thereby providing a pivot for latch lever 36.

Cam portion 52 of shaft 42 actuates as latch lever 36 rotates on pivot shaft 42 such that latching shoulder 38 engages V-slot lock 54 on a complementary mating receptacle or connector 26 engaged on the pins 12 of the pin array within cavity 24. As latch lever 36 pivots, foot 40, which is arcuate and may be concentric with shaft 42, clears surface 56.

Latch lever recess 34 accommodates two pins **12*a* and 12*b* on each side of latch lever 36 with pin 12*a* on one side of shaft 42 and pin 12*b* on the other side of shaft 42. In the unlatched position, latch lever 36 is rotated outwardly from end wall 30 with foot 40 rotated into cavity 24. The smaller axis of cam 52 passes between adjacent pins 12*a* and 12*b* with the larger axis of cam 52 generally aligned with the axis of pins 12**.

Shroud 10 includes surface 58 tangent to shaft 42 and spaced from the unbiased position of pin **12*a*. Surface 58 tapers such that latch lever recess 34 is narrower transverse to the axis of shaft 42 at the top surface 60 of endwall 30 than at the axis of shaft 42. Surface 62 is contiguous with surface 58 and is also spaced from the unbiased position of pin 12*a* at least where contiguous with surface 58**.

With shroud 10 plugged into an array of pins 12, the shroud acts as an identifier of pins for mating with a mating connector 26 inserted into cavity 24. Connector 26 engages foot 40 as the mating face 64 approaches top inside surface 20. Latching shoulder 38 is seated in V-slot lock 54 by pressing on latch lever 36 thereby rotating latch lever 36 about shaft 42. In rotating latch lever 36, cam 52 simultaneously rotates deflecting pin 12*a* biasing pin 12*a* into a recessed region against surface 58 thereby securing shroud 10 to the pin array. In a preferred embodiment, cam 52 is cammed over center such that the larger axis of cam 52 is at an angle with respect to horizontal. Pin 12*b* provides support for shaft 42 to prevent the lateral force due to the camming action from shearing shaft 42. Although shroud 10 can still be pulled off pin array 12, a much greater force, on the order of 30 pounds, is required. As shroud 10 is pulled away from board 14, pin 12*a* biased against surface 58 wedges in the narrowing recess 34 and resists being pulled off the pin array 12. Shroud 10 will thus withstand forces in the normal range associated with a terminated cable.

To remove shroud 10 from pin array 12, latching shoulder 38 is released from latching engagement in V-slot lock 54. Latch lever 36 is rotated away from endwall 30 with foot 40 engaging the mating face of mating connector 26 pushing the mating face away from surface 20. Simultaneously cam 52 rotates releasing pin 12*a*. Connector 26 is removed from cavity 24. Pin 12*a* being resilient returns to its unbiased position. Shroud 10 is then secured to the pin field only by the interference fit provided by pins in pin receiving passages 22*a*. Only a small force is required to remove shroud 10 from pin array 12.

Figure 5:
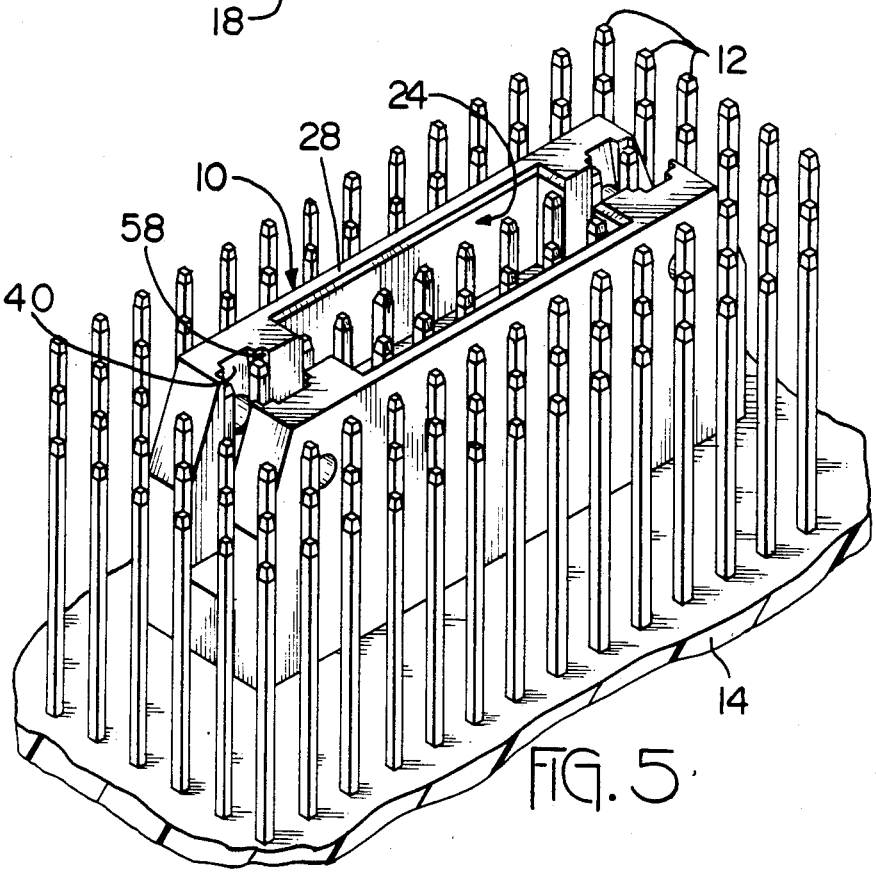
FIG. 5 is a perspective view of a shroud with latch levers removed in a pin field.
Figure 6:
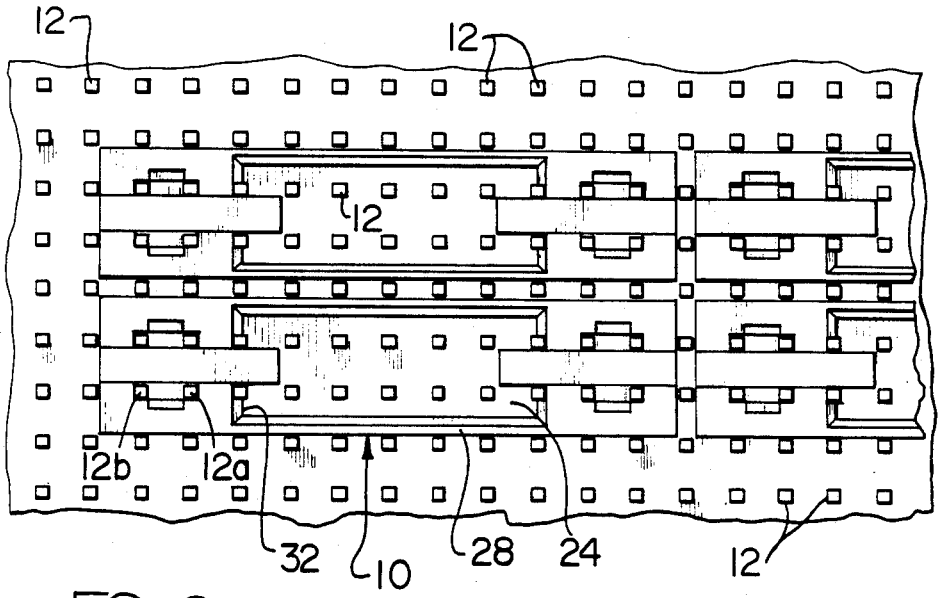
FIG. 6 is a plan view of a shroud with latch levers removed.
Figure 7:
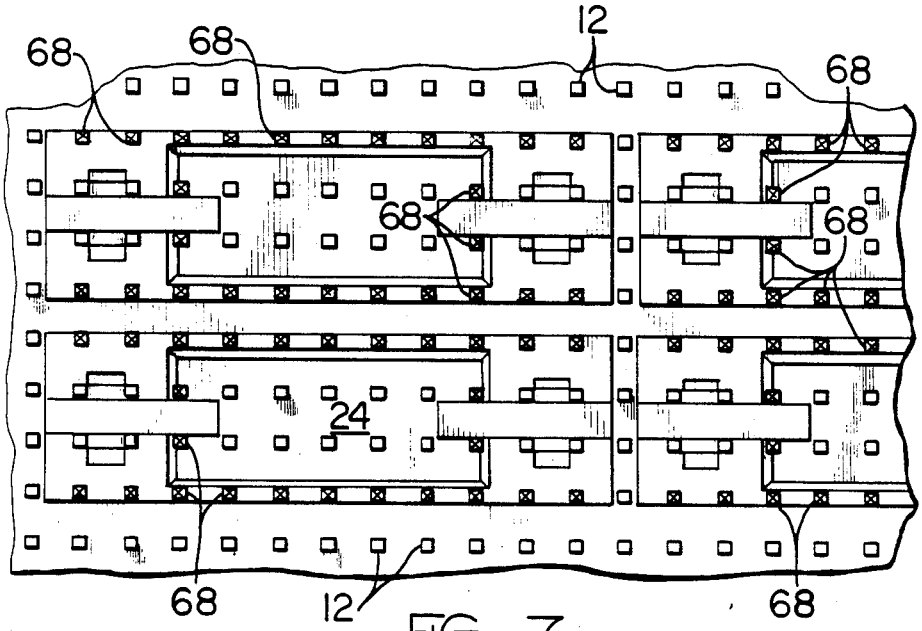
FIG. 7 is a plan view of a prior art shroud with latch levers removed.

Shroud 10 is adapted to be secured in pin array 12 without removing any pins or providing apertures through circuit board 14. Some of the pins in pin array 12 are not useable on the tail side of board 14, such as pins 12*a* and 12*b*, but the unuseable pins need not be removed from board 14. As seen in FIGS. 5 and 6, shroud 10 fits between rows of pins 12. Shroud 10 can be removed and repositioned leaving all pins in pin array 12 in their initial condition. FIG. 7 illustrates that prior art shrouds necessitated removing the pins 68.

Figure 8:
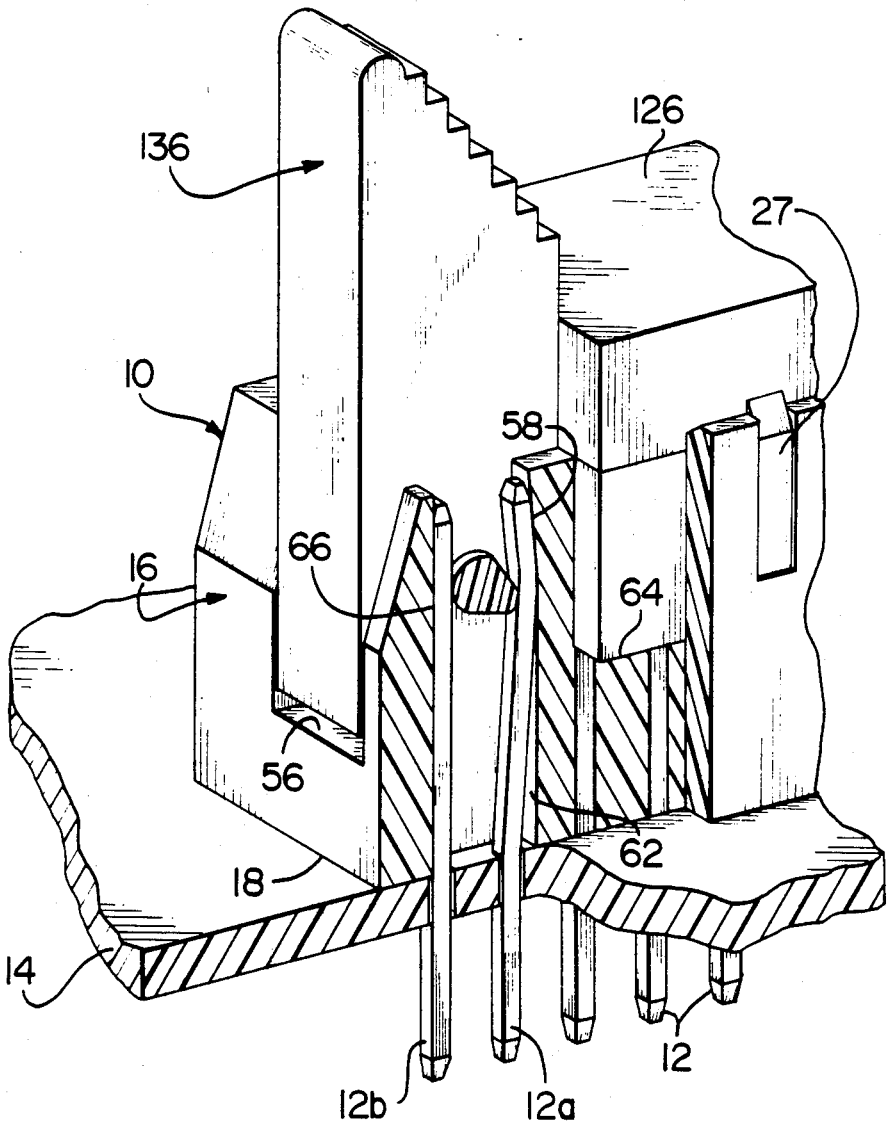
FIG. 8 is an alternate embodiment of the locking shroud.

In an alternate embodiment shown in FIG. 8 lever 136 does not necessarily latchingly engage connector 126. Connector 126 may be secured to shroud 10 by other means. In this embodiment of shroud 10, with lever 136 engaging connector 126 the larger axis of cam 52 is cammed over center to be at an angle with respect to horizontal. Pin 12*a* is biased against surface 58. Pin 12*a* biases the rotation of cam 52 and lever 136 to maintain engagement between lever 136 and connector 126.

We claim:

1. A shroud for reception on a pin array extending from a printed circuit board, comprising:

a dielectric housing, said housing having walls, a base having a bottom surface for disposition against a printed circuit board, and a plurality of pin receiving passages extending from the bottom surface of the base, said pin receiving passages corresponding in spacing to the spacing of pins in the pin array; and camming means on the housing for deforming a pin in the pin array and for biasing the deformed pin against said housing, whereby the shroud is adapted to be received on and secured to a pin array with the bottom surface of the housing retained against a printed circuit board.

2. A shroud for reception on a pin array as recited in claim 1 wherein the dielectric housing of said shroud is adapted to be positioned on the pin array without removal of any pins.

3. A shroud for reception on a pin array as recited in claim 1 wherein the camming means is mounted in a wall of said housing.

4. A shroud for reception on a pin array as recited in claim 1 wherein the dielectric housing defines an elongate cavity adapted to receive a complementary mating connector therein.

5. A shroud for reception on a pin array as recited in claim 4 wherein said cavity is profiled for polarized mating with said connector.

6. A latching shroud for reception on a pin array extending from a printed circuit board, comprising:

an elongate housing defining an elongate cavity adapted to receive a complementary mating connector therein;

a pivotally mounted latch means in said housing, said latch means having a latch arm portion adapted to latchingly engage the mated connector, and pivot means integral with an intermediate section of said latch arm rotatably mounting said latch means in said housing, said pivot means including cam means for biasing a pin into engagement with the housing, whereby biasing the pin into engagement with the housing secures the shroud to the pin array.

7. A latching shroud for reception on a pin array as recited in claim 6 wherein the latch means is mounted in an endwall of said housing.

8. A latching shroud for reception on a pin array as recited in claim 6 wherein the dielectric housing is adapted to be positioned on the pin array without removal of any pins.

9. A latching shroud for reception on a pin array as recited in claim 6 wherein the shroud further comprises a further pivotally mounted latch means mounted in the housing.

10. A latching shroud for reception on a pin array as recited in claim 6 wherein said cavity is profiled for polarized mating with said connector.

11. A latching shroud for reception on a pin array as recited in claim 6 wherein the housing further comprises a base having a bottom surface for disposition against said printed circuit board, an opposed inside surface and a plurality of pin receiving passages extending between said surfaces, said pin receiving passages corresponding in spacing to the pins in the pin array.

12. A latching shroud for reception on a pin array extending from a printed circuit board, comprising:

an elongate housing defining an elongate cavity adapted to receive a complementary mating connector therein;

a pivotally mounted latch and eject means in said housing, said latch and eject means having a latch arm portion adapted to latchingly engage the mated connector, an eject portion capable of extending into the cavity to engage a mating face of said connector, and pivot means integral with an intermediate section of said latch arm rotatably mounting said latch and eject means in said housing, said pivot means including cam means for biasing a pin into engagement with the housing, whereby biasing the pin into engagement with the housing secures the shroud to the pin array.

13. A latching shroud for reception on a pin array as recited in claim 12 wherein the dielectric housing is adapted to be positioned on the pin array without removal of any pins.

14. A latching shroud for reception on a pin array as recited in claim 12 wherein the eject portion of the latch and eject means passes between two rows of pins in the pin array.

15. A latching shroud for reception on a pin array as recited in claim 12 wherein the shroud further comprises a further pivotally mounted latch and eject means in the housing.

16. A latching shroud for reception on a pin array as recited in claim 12 wherein said cavity is profiled for polarized mating with said connector.

17. A latching shroud for reception on a pin array as recited in claim 12 wherein the latch and eject means is mounted in an endwall of said housing.

18. A shroud for reception on a pin array extending from a printed circuit board, comprising:

an elongate housing defining an elongate cavity adapted to receive a complementary mating connector therein, said housing having a recess adjacent to a pin receiving region, said recess adapted to receive a biased pin of the array; and means for biasing said pin into said recess whereby, upon reception of the shroud on a pin array, biasing said pin into said recess secures the shroud to the pin array.

19. A shroud as recited in claim 18 wherein biasing a pin into said recess biases the pin into engagement with the housing.

20. A shroud as recited in claim 18 further comprising latch means on said housing, said latch means having a latch arm portion adapted to latchingly engage a mated connector.

21. A shroud as recited in claim 20 wherein said biasing means is actuated by said latch means.

22. A shroud as recited in claim 18 further comprising eject means for extending into the cavity to engage a mated connector received therein and for assisting in demating a mated connector.

* * * * *